United States Patent [19]

Kawagishi et al.

[11] Patent Number: 4,639,413

[45] Date of Patent: Jan. 27, 1987

[54] SILVER HALIDE COLOR PHOTOGRAPHIC MATERIALS CONTAINING MAGENTA COUPLER AND HIGH BOILING POINT ORGANIC SOLVENT

[75] Inventors: Toshio Kawagishi; Kiyoshi Nakazyo, both of Kanagawa, Japan

[73] Assignee: Fuji Photo Film Co., Ltd., Kanagawa, Japan

[21] Appl. No.: 765,626

[22] Filed: Aug. 14, 1985

[30] Foreign Application Priority Data

Aug. 14, 1984 [JP] Japan ..... 59-169856

[51] Int. Cl.[4] ..... G03C 1/08; G03C 7/26; G03C 7/32

[52] U.S. Cl. ..... 430/546; 430/386; 430/387; 430/473; 430/505; 430/558; 430/601; 430/610

[58] Field of Search ..... 430/546, 558, 505, 386, 430/387, 476, 601, 610

[56] References Cited

U.S. PATENT DOCUMENTS

| | | | |
|---|---|---|---|
| 2,322,027 | 6/1943 | Jelley et al. | 430/552 X |
| 3,705,896 | 12/1972 | Bailey | 548/181 |
| 3,725,067 | 4/1973 | Bailey et al. | 548/159 |
| 4,278,757 | 7/1981 | Mukunoki et al. | 430/546 X |
| 4,326,022 | 4/1982 | Ito et al. | 430/546 |
| 4,500,630 | 2/1985 | Sato et al. | 430/558 X |
| 4,524,132 | 6/1985 | Aoki et al. | 430/558 X |
| 4,540,654 | 9/1985 | Sato et al. | 430/558 X |
| 4,548,899 | 10/1985 | Nakayama et al. | 430/558 |

FOREIGN PATENT DOCUMENTS

| | | | |
|---|---|---|---|
| 0143570 | 6/1985 | European Pat. Off. | 430/558 |
| 2805706 | 8/1978 | Fed. Rep. of Germany | 430/546 |
| 0133545 | 7/1984 | Japan | 430/546 |
| 2091124 | 7/1982 | United Kingdom | 430/546 |

OTHER PUBLICATIONS

Research Disclosure #24626, Oct. 1984, pp. 498–501.

*Primary Examiner*—John E. Kittle
*Assistant Examiner*—Mukund J. Shah
*Attorney, Agent, or Firm*—Sughrue, Mion, Zinn, Macpeak, and Seas

[57] ABSTRACT

A silver halide color photographic material is described, comprising a support having formed thereon at least one silver halide emulsion layer having dispersed therein, in a coexisting state, at least one magenta coupler represented by formula (I) and at least one high-boiling point organic solvent represented by the formula (II)

(I)

(II)

wherein $R^1$ and $R^2$ each represents a hydrogen atom or a substituent and x represents a hydrogen atom or a group capable of being released by a coupling reaction with the oxidation product of an aromatic primary amine developing agent; and wherein $R^3$, $R^4$, and $R^5$ each represents an alkyl group, a cycloalkyl group, or an alkenyl group, and the total number of carbon atom of the groups $R^3$, $R^4$ and $R^5$ is from 12 to 60.

8 Claims, 2 Drawing Figures

SILVER HALIDE COLOR PHOTOGRAPHIC MATERIALS CONTAINING MAGENTA COUPLER AND HIGH BOILING POINT ORGANIC SOLVENT

FIELD OF THE INVENTION

This invention relates to a silver halide color photographic material and, more particularly, to a silver halide color photographic material having improved color reproducibility and color image fastness.

BACKGROUND OF THE INVENTION

For silver halide color photographic materials, a system of using light-sensitive silver halide emulsions and so-called dye-forming couplers (hereinafter simply referred to as couplers), which form dyes by reaction with the oxidation product of an aromatic primary amine developing agent, is frequently used. A combination of a yellow coupler, a cyan coupler, and a magenta coupler is usually used for color photographic materials.

More particularly, 5-pyrazolone couplers are frequently used as magenta couplers for color photographic materials, but 5-pyrazolone couplers have a side absorption at about 430 nm and show an undesirable end form in the characteristic curve at the long wavelength side, which causes serious problems in color reproduction.

1H-Pyrazolo[5,1-c][1,2,4]triazole couplers are known as magenta couplers for overcoming such difficulties, and it is known that the magenta dye obtained by the coupling reaction of the coupler of the skeleton and the oxidation product of an aromatic primary amine developing agent does not have a side absorption at about 430 nm in an ethyl acetate solution and shows a magenta color showing a desirable end form of the characteristic curve at the long wavelength side and having high purity. However, in a photographic film or photographic paper obtained by exposing and color developing a photographic material having silver halide emulsion layers containing the 1H-pyrazolo[5,1-c][1,2,4]triazole couplers dispersed therein using a high-boiling point organic solvent, the transmission or reflection spectra do not always show a good end form of the characteristic curves at the long wavelength side, the improvement of color reproducibility is insufficient, and also the light fastness of color images formed is insufficient.

SUMMARY OF THE INVENTION

A first object of this invention is to provide a silver halide color photographic material showing improved color reproducibility by forming magenta dye images having a good end form of the characteristics curve at the long wavelength side and excellent hue using 1H-pyrazolo[5,1-c][1,2,4]triazole couplers.

A second object of this invention is to provide a silver halide color photographic material having improved light fastness of color images in a system using 1H-pyrazole[5,1-c][1,2,4]triazole couplers.

It has now been discovered that the above-described objects of this invention can be attained by a silver halide color photographic material comprising a support having formed thereon at least one silver halide emulsion layer having dispersed therein, in a coexisting state, at least one magenta coupler represented by formula (I) with at least one high-boiling point organic solvent represented by formula (II)

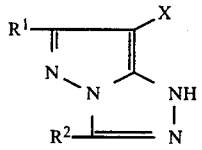

(I)

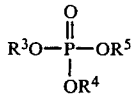

(II)

wherein $R^1$ and $R^2$ each represents a hydrogen atom or a substituent and X represents a hydrogen atom or a group capable of being released by a coupling reaction with the oxidation product of an aromatic primary amine developing agent; and wherein, $R^3$, $R^4$ and $R^5$ each represents an alkyl group, a cycloalkyl group, or an alkenyl group, and the total number of carbon atoms of the groups $R^3$, $R^4$, and $R^5$ is from 12 to 60.

The magenta coupler may exist in the form of a dimer, oligomer, or polymer by bonding at $R^1$, $R^2$, or X. In case of the polymer, the upper limit of the average molecular weight thereof is 1,000,000.

In formula (I), an oligomer means a coupler having two or more groups represented by formula (I) in one molecule, and includes a bis-compound and polymeric coupler. The polymeric coupler may be a homopolymer composed of the monomer (preferably having a vinyl group, with such a monomer being hereinafter referred to as vinyl monomer) having only the moiety represented by formula (I) or may be a copolymer of the aforesaid monomer and a non-coloring ethylenic monomer which does not cause coupling with the oxidation product of an aromatic primary amine developing agent.

The "coexisting state" referred to herein means a state where the both of the magenta coupler and the high-boiling point organic solvent are at least partially mutually dissolved, and preferably, they both form a true solution.

DESCRIPTION OF THE PREFERRED EMBODIMENT

Figure 1:
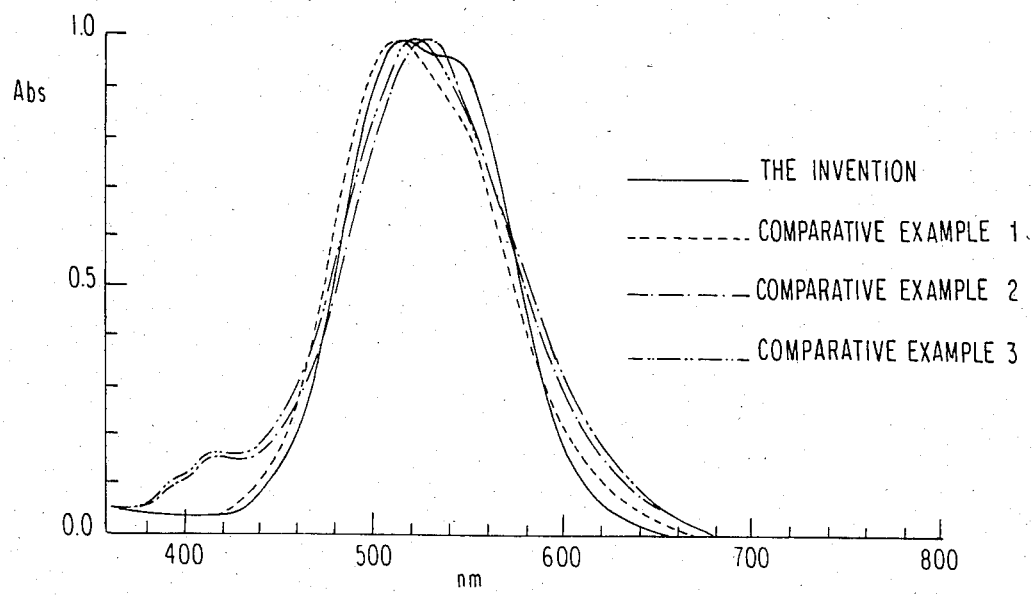
FIG. 1 shows the absorption spectra of magenta colored dyes in a solution.

The magenta couplers for use in this invention represented by formula (I) are explained below in detail.

In formula (I), $R^1$ and $R^2$ each represents a hydrogen atom or a substituent such as a halogen atom, an alkyl group, an aryl group, a heterocyclic ring group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, etc. X represents a hydrogen atom or a group capable of being released by a coupling reaction with the oxidation product of an aromatic primary amine developing agent such as a halogen atom, a carboxy group, or a group bonded to the carbon atom at the coupling position through an oxygen atom, a nitrogen atom, or a sulfur atom, which is released by a coupling reaction.

The magenta coupler of formula (I) also includes those wherein $R^1$, $R^2$, or X is a divalent group to form a bis-compound. Also, when the moiety shown by formula (I) exists in a vinyl monomer, $R^1$ or $R^2$ represents a chemical bond or linkage group, and the moiety thus represented by formula (I) is bonded to a vinyl group through the bond or linkage group.

More preferably, $R^1$ and $R^2$ each represents a hydrogen atom, a halogen atom (e.g., a chlorine atom, a bromine atom, etc.), an alkyl group (e.g., a methyl group, an ethyl group, a propyl group, a t-butyl group, a trifluoromethyl group, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecaneamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a methylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-t-aminophenoxy)butylamido group, a γ-(3-t-butyl-4-hydroxyphenoxy)butylamido group, an α-{4-(4-hydroxyphenylsulfonyl)phenoxy}decanamido group, etc.), an anilino group (e.g., a phenylamino group, a 2-chloro-5-tetradecanamidoanilino group, a 2-chloro-5-dodecyloxycarbonylanilino group, an N-acetylanilino group, a 2-chloro-5-{α-(3-t-butyl-4-hydroxyphenoxy)dodecanamido}anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)-phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a heterocyclic thio group (e.g., a 2-benzothiazolythio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbomoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-{3-(2,4-di-tert-amylphenoxy)propyl}carbomoyl group, etc.), an acyl group (e.g., an acetyl group, a (2,4-di-tert-amylphenoxy)acetyl group, a benzyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecylcarbonyl group, an octadecylcarbonyl group, etc.), or an aryloxycarbonyl group (e.g., a phenyloxycarbonyl group, or a 3-pentadecyloxycarbonyl group, etc.). Among them, it is preferred that both $R^1$ and $R^2$ represent an alkyl group, and it is more preferred that $R^1$ represents a methyl group and $R^2$ represents a substituted alkyl group.

Also, X represents a hydrogen atom, a halogen atom (e.g., a chlorine atom, a bromine atom, an iodine atom, etc.), a carboxy group, a group linking by an oxygen atom (e.g., an acetoxy group, a propanoyloxy group, a benzoyloxy group, a 2,4-dichlorobenzoyloxy group, an ethoxyoxaloyloxy group, pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a group linking by a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperizyl group, a 5,5-dimethyl-2,4-dioxo-3-oxazolydinyl group, a 1-benzylethoxy-3-hydantoinyl group, a 2N-1,1-dioxo-3(2H)-oxo-1,2-benzisothiazolyl group, a 2-oxo-1,2-dihydro-1-pyridinyl group, an imidazolyl group, a pyrazolyl group, a 3,5-diethyl-1,2,4-triazole-1-yl, a 5- or 6-bromo-benzotriazole-1-yl, or a 5-methyl-1,2,3,4-triazole-1-yl group, a benzimidazolyl group, a 3-benzyl-1-hydantoinyl group, a 1-benzyl-5-hexadecyloxy-3-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.), or a group linking by a sulfur atom (e.g., a phenylthio group, a 2-carboxyphenylthio group, a 2-methoxy-5-t-octylphenylthio group, a 4-methanesulfonylphenylthio group, 4-octanesulfonamidophenylthio group, a 2-butoxyphenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazole-5-thio group, a sulfo group, etc.). Among them, it is preferred that X represents a halogen atom or a group linking by an oxygen atom.

When $R^1$, $R^2$ or X becomes a divalent group to form a bis-form, the divalent group includes a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group,

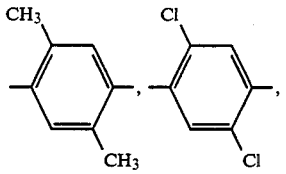

etc.), or $—NHCO—R_2—CONH—$ (wherein $R_2$ represents a substituted or unsubstituted alkylene or phenylene group).

When the moiety represented by formula (I) is in an ethylenically unsaturated type monomer, the linkage group represented by $R^1$ and $R^2$ includes a group composed of a combination of the groups selected from an alkylene group (substituted or unsubstituted alkylene group such as a methylene group, an ethylene group, a 1,10-decylene group, $—CH_2CH_2OCH_2CH_2—$, etc.), a phenylene group (substituted or unsubstituted phenylene group such as a 1,4-phenylene group, a 1,3-phenylene group,

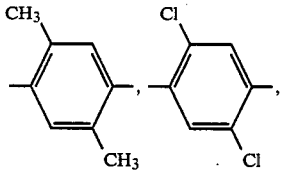

etc.), —NHCO—, —CONH—, —O—, —OCO—, and an aralkylene group (e.g.,

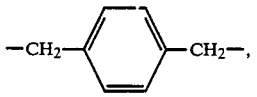

-continued

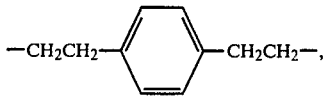

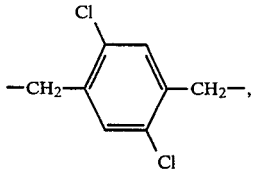

etc.).

In addition, the ethylenically unsaturated group in the ethylenically unsaturated type monomer includes, in addition to those represented by formula (I), the moieties represented by formula (I) having further substituents. Examples of the preferred substituents include a hydrogen atom, a chlorine atom, and a lower alkyl group having from 1 to 4 carbon atoms.

The non-coloring ethylenic monomer which does not cause coupling reaction with the oxidation product of an aromatic primary amine developing agent includes acrylic acid, α-chloroacrylic acid, α-aracryl group (e.g., methacrylic acid, etc.), esters and amides derived from these acrylic acids (e.g., acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl methacrylate, methyl methacrylate, ethyl methacrylate, n-butyl methacrylate, β-hydroxy methacrylate, methylenedibisacrylamide, etc.), vinyl esters (e.g., vinyl acetate, vinyl propionate, vinyl laurate, etc.), acrylonitrile, methacrylonitrile, aromatic vinyl compounds (e.g., styrene and the derivatives thereof such as vinyltoluene, divinylbenzene, vinylacetophenone, sulfostyrene, etc.), itaconic acid, citraconic acid, crotonic acid, vinyl alkyl ethers (e.g., vinyl ethyl ether, etc.), N-vinyl-2-pyrrolidone, N-vinylpyridine, 2- or 4-vinylpyrydiene, etc.)

Examples and synthesis methods of the couplers represented by formula (I) above are described in U.S. Pat. Nos. 3,705,896, 3,725,067; Japanese Patent Application (OPI) No. 99,437/'84 (the term "OPI" as used herein refers to a "published unexamined Japanese patent application"), Japanese Patent Application No. 250,345/'83, etc.

Specific examples of the couplers represented by formula (I) are shown below, but the couplers for use in this invention are not limited there to.

(M-1)

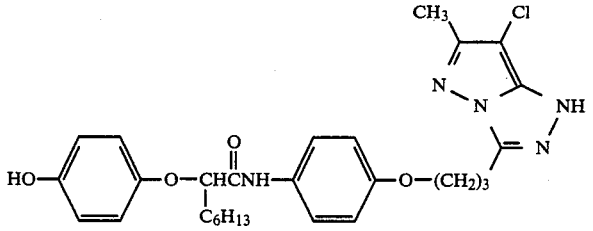

-continued
(M-2)
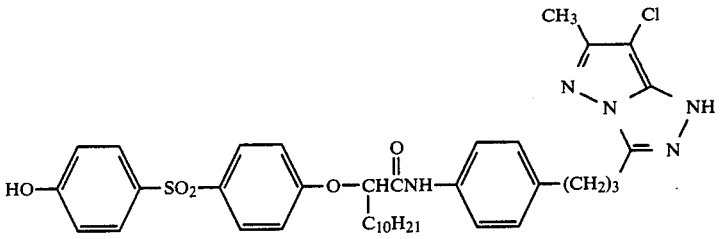
(M-3)
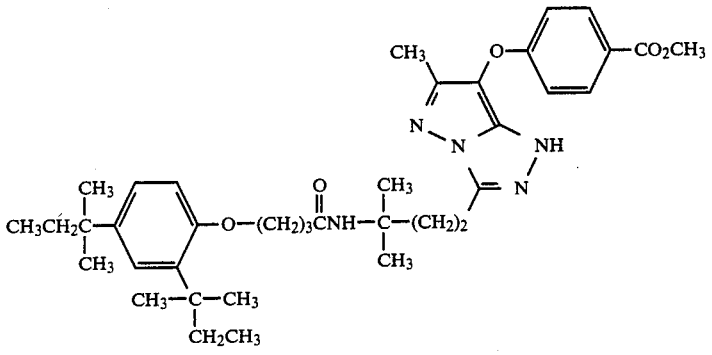
(M-4)
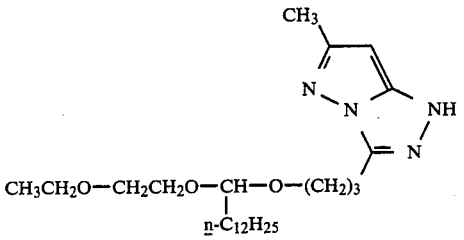
(M-5)
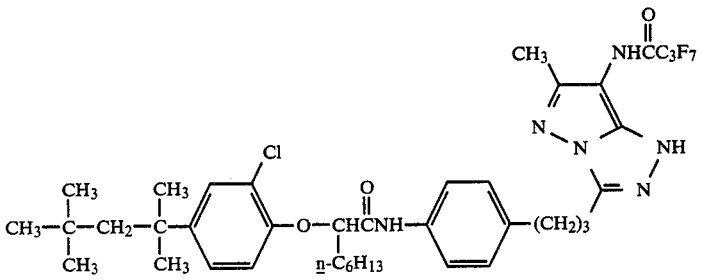
(M-6)
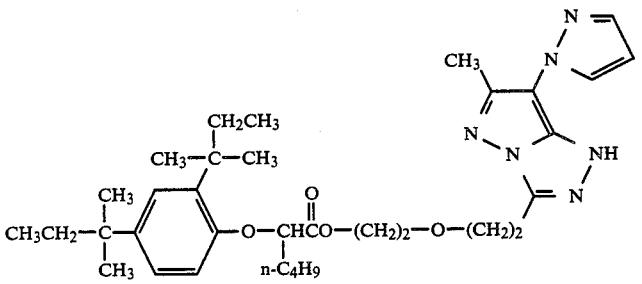

-continued
(M-7)
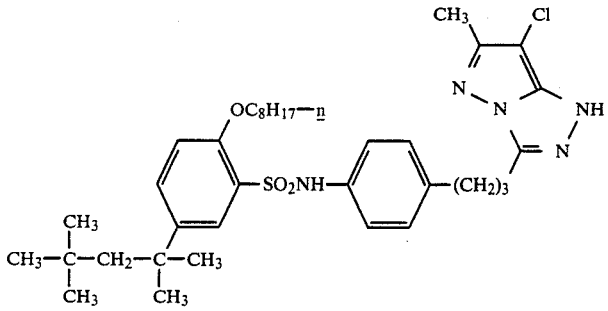
(M-8)
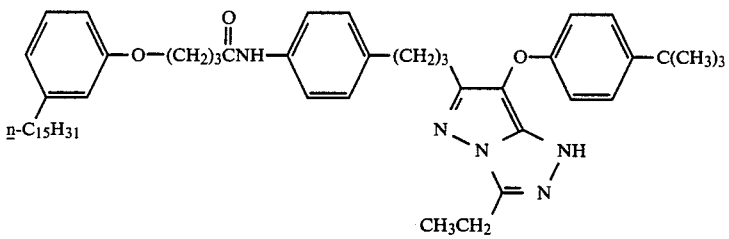
(M-9)
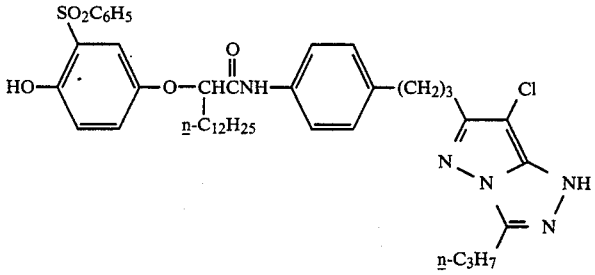
(M-10)
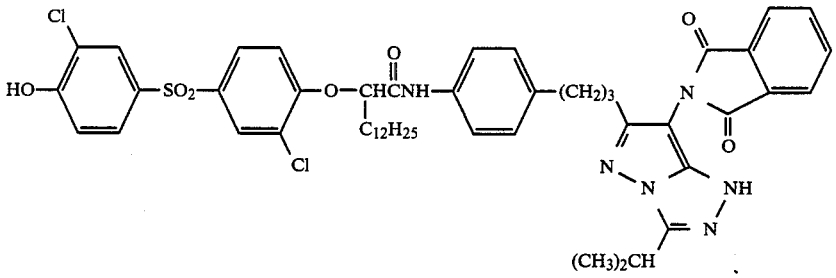
(M-11)
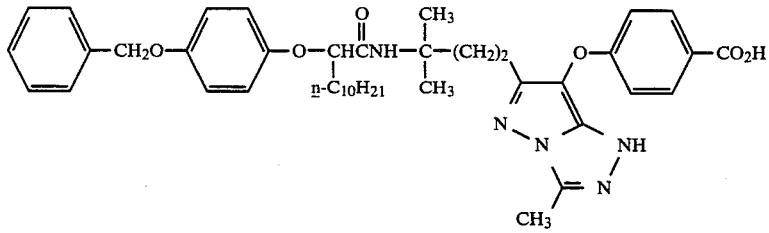
(M-12)
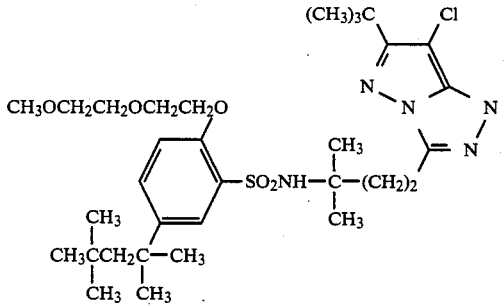

-continued
(M-13)
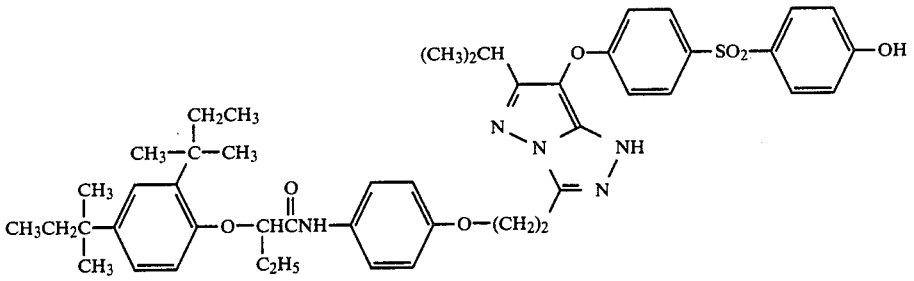
(M-14)
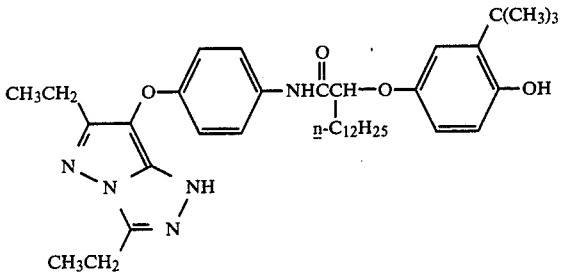
(M-15)
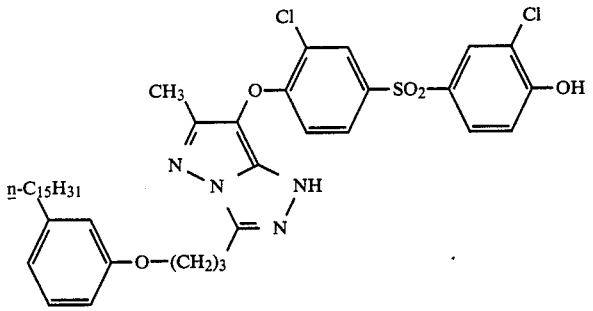
(M-16)
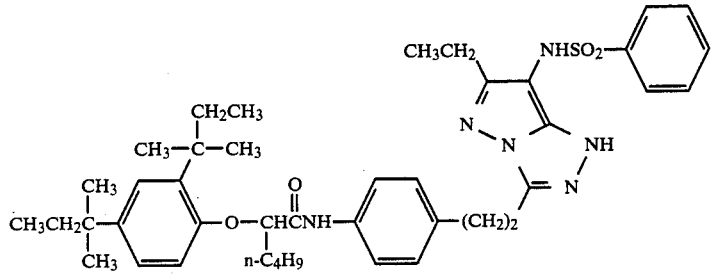
(M-17)
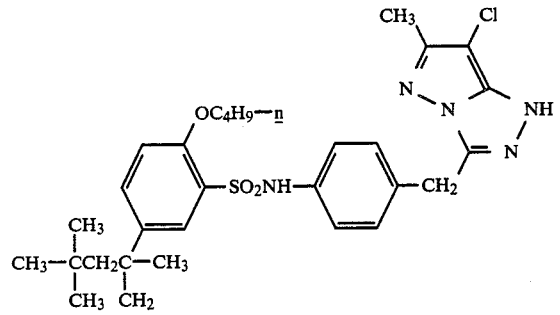

-continued
(M-18)
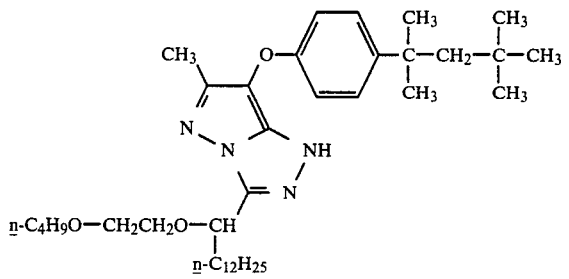
(M-19)
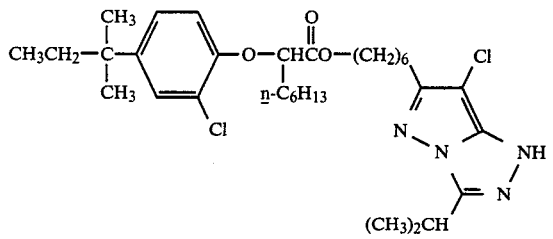
(M-20)
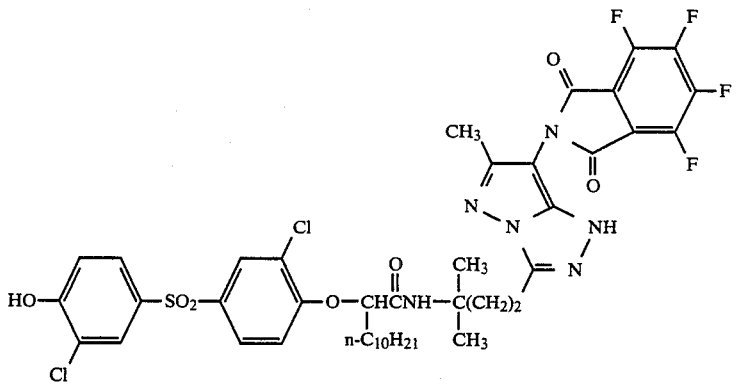
(M-21)
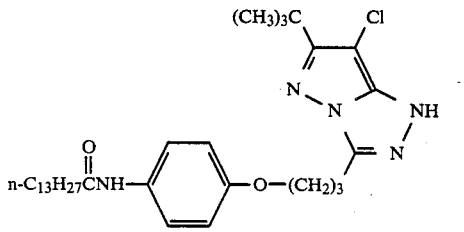
(M-22)
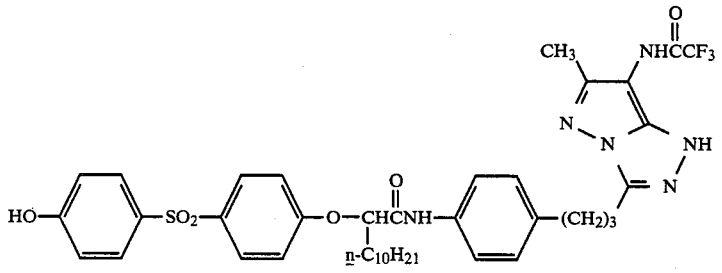

-continued
(M-23)
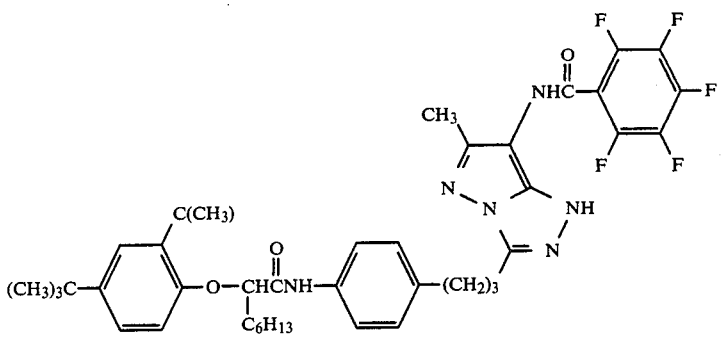
(M-24)
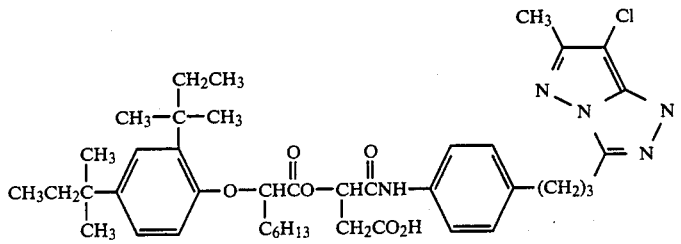
(M-25)
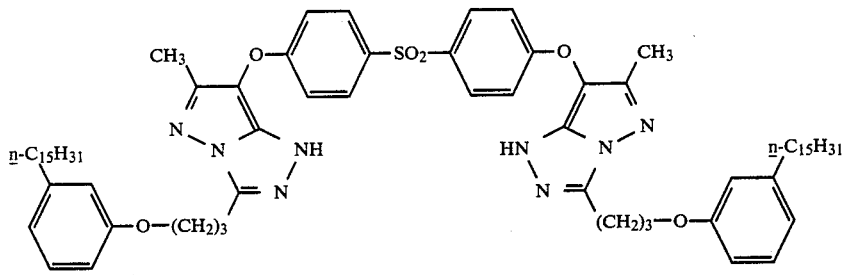
(M-26)
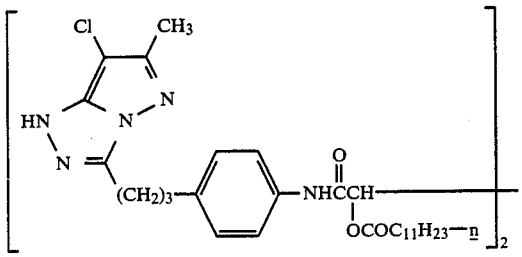
(M-27)
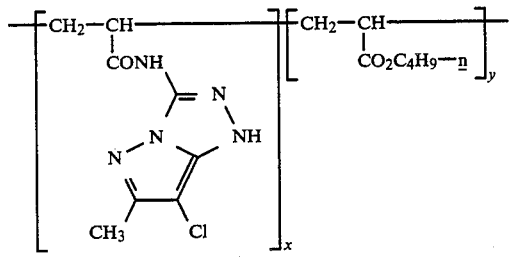
x:y = 50:50
( )

-continued (M-28)

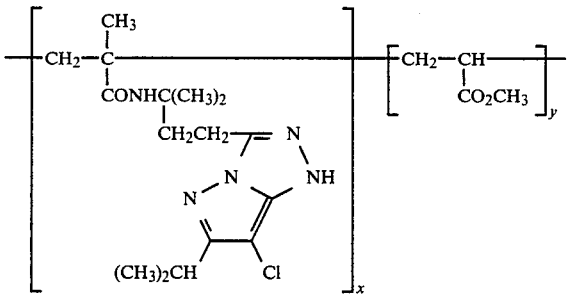

x:y = 45:55

(M-29)

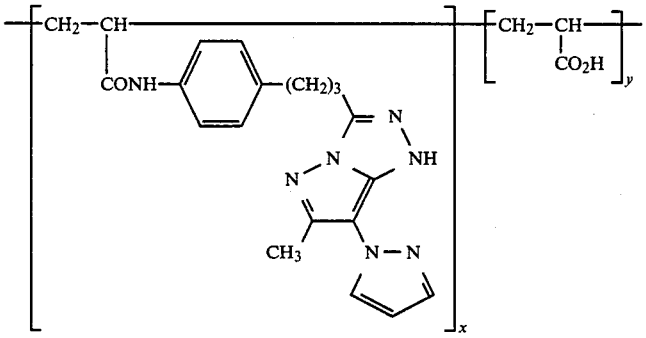

x:y = 50:50

(M-30)

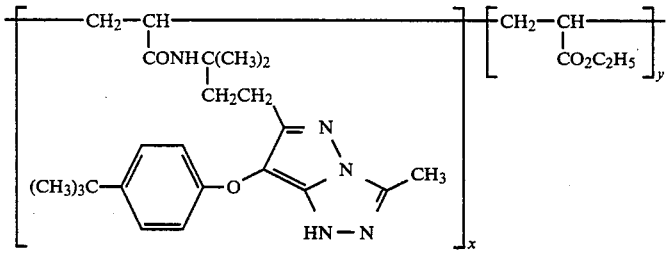

x:y = 40:60

The total number of carbon atom of the groups $R^3$, $R^4$, and $R^5$ of above-described formula (II) is from 12 to 60. If the carbon atom number is outside the range, the improving effect for the object of this invention is reduced, and further, if the total carbon atom number is over 60, the ability of the solvent to dissolve the coupler is reduced, to sometimes precipitate the coupler.

The alkyl group represented by $R^3$, $R^4$, and $R^5$ of formula (II) may be a straight chain alkyl group or a branched alkyl group, and includes, for example, a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, etc.

The cycloalkyl group represented by $R^3$, $R^4$, and $R^5$ includes a cyclopentyl group, a cyclohexyl group, etc.

Also, the alkenyl group represented by $R^3$, $R^4$, and $R^5$ includes a butenyl group, a pentenyl group, a hexenyl group, a heptenyl group, an oxtenyl group, a decenyl group, a dodecenyl group, an octadecenyl group, etc.

These alkyl groups, cycloalkyl groups, and alkenyl groups each may have at least one substituent. Examples of the substituent for the alkyl group, cycloalkyl group and alkenyl group include a halogen atom (e.g., a fluorine atom, a chlorine atom, etc.) an alkoxy group (e.g., a methoxy group, an ethoxy group, a butoxy group, etc.), an aryl group (e.g., a phenyl group, a tolyl group, a naphthyl group, etc.), an aryloxy group (e.g., phenoxy group, etc.), an alkenyl group, an alkoxycarbonyl group, etc.

Each of $R^3$, $R^4$, and $R^5$ is preferably a 2-ethylhexyl group, a 7-methyloctyl group, a cyclohexyl group, or a straight chain alkyl group having from 8 to 18 carbon atoms.

In this invention, the high-boiling organic solvent is an organic solvent having a boiling point of at least 175° C.

The optimum amount of the high-boiling point organic solvent represented by formula (II) may be selected according to the kind and the amount of the magenta coupler represented by formula (I), but it is generally preferred that the ratio of high-boiling point organic solvent/magenta coupler is from 0.05/1 to 20/1 by weight ratio.

The high-boiling point organic solvent represented by formula (II) may be used together with other known high-boiling solvents in a range of not reducing the effect of this invention. Examples of such a high-boiling point organic solvent which can be used together with the organic solvent in this invention include aryl phosphate series solvents, such as tricresyl phosphate, etc.; phthalic acid ester series solvents, such as dibutyl phthalate, di-2-ethylhexyl phthalate, etc.; amide series solvents, such as N,N-diethyldodecanamide, etc.; fatty acid ester series solvents; benzoic acid ester series solvents; phenol series solvents such as 2,5-di-tert-amylphenol, etc.

Specific examples of the high-boiling point organic solvent represented by formula (I) are shown below, but the invention is not limited to these materials.

$O{=}P(OC_4H_9{-}n)_3$ (S-1)

$O{=}P(OCH_2CH_2CH(CH_3)CH_3)_3$ (S-2)

$O{=}P(OC_6H_{13}{-}n)_3$ (S-3)

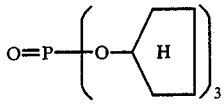
(S-4)

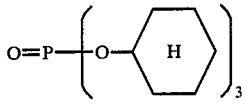
(S-5)

$O{=}P(OC_8H_{17}{-}n)_3$ (S-6)

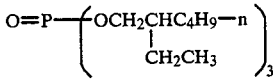
(S-7)

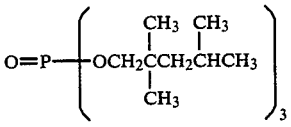
(S-8)

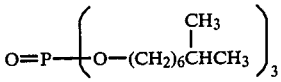
(S-9)

$O{=}P(OC_9H_{19}{-}n)_3$ (S-10)

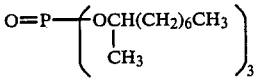
(S-11)

$O{=}P(OC_{10}H_{21}{-}n)_3$ (S-12)

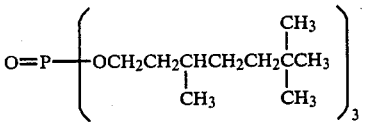
(S-13)

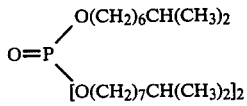
(S-14)

-continued

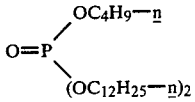
(S-15)

$O{=}P(OC_{12}H_{25}{-}n)_3$ (S-16)

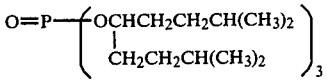
(S-17)

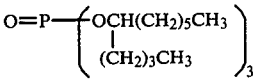
(S-18)

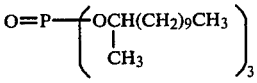
(S-19)

$O{=}P(OC_{14}H_{29}{-}n)_3$ (S-20)

$O{=}P(OC_{15}H_{31}{-}n)_3$ (S-21)

$O{=}P(OC_{16}H_{33}{-}n)_3$ (S-22)

$O{=}P(OCH{=}CHC_{16}H_{33})_3$ (S-23)

As a method of introducing the magenta coupler for use in this invention represented by formula (I) together with the solvent for use in this invention represented by formula (II) in a coexisting state into a silver halide color photographic material, the method known as an oil protect method as described, for example, in U.S. Pat. No. 2,322,027 is generally used.

The phosphoric acid ester series coupler solvent for use in this invention generally has very good dissolving property for the magenta coupler for use in this invention, but if the dissolution of the coupler in the solvent is insufficient owing to the selection of a low ratio of coupler solvent/coupler, another coupler solvent such as a phthalic acid ester series coupler solvent can be used in combination therewith. Furthermore, in this invention, before dissolving the coupler for use in this invention in the coupler solvent for use in this invention, the coupler may be dissolved in a low-boiling organic solvent having a boiling point of from about 30° to 150° C., for example, acetic acid esters such as lower alkyl acetates (e.g., butyl acetate), ethyl propionate, secondary butyl alcohol, trimethyl isobutyl ketone, β-ethoxyethyl acetate, methylcellosolve acetate, etc.

In this invention, various color couplers can be used in addition to the couplers represented by formula (I). The color coupler (or color-forming coupler) in this invention is a compound capable of forming a dye by causing reaction with the oxidation product of an aromatic primary amine developing agent.

Typical examples of the useful color couplers are naphtholic or phenolic compounds, pyrazolone, or pyrazoloazole series compounds, and open chain or heterocyclic ketomethylene compounds. Cyan, magenta, and yellow couplers, which can be used in this invention, are described in the patents cited in *Research Disclosure,* No. 17643, Chapter VII (1978, December), ibid. No. 18717 (November, 1979).

It is preferred that these couplers have a ballast group or are polymerized non-diffusible couplers. Also, couplers providing colored dyes having appropriate diffusibility, colored couplers, non-coloring couplers, or couplers releasing a developing inhibitor or developing accelerator with the coupling reaction can be used in this invention.

Typical examples of the yellow couplers which can be used in this invention are oil protected type acylacetamide series couplers. Specific examples of the yellow couplers are described, for example, in U.S. Pat. Nos. 2,407,210, 2,875,057, and 3,265,506. In this invention, two-equivalent yellow couplers are preferably used and typical examples of such couplers are oxygen atom-releasing type yellow couplers described, for example, in U.S. Pat. Nos. 3,408,194, 3,447,928, 3,933,501, 4,401,752, etc., and nitrogen atom-releasing type yellow couplers described in, for example, Japanese Patent Publication No. 10,739/'83; U.S. Pat. Nos. 4,022,620, 4,326,024; *Research Disclosure,* No. 18053 (1979, April), U.K. Pat. No. 1,425,020; West German Patent Application (OLS) Nos. 2,219,917, 2,261,361, 2,329,587, and 2,433,812. α-pivaloylacetanilide series couplers yield colored dyes of good fastness and α-benzoylacetanilide series couplers have a good coloring property.

Magenta couplers that can be used include oil protected type indazolo series or cyanoacetyl series couplers, and, preferably, pyrzoloazole series couplers such as 5-pyrazolone series couplers and pyrazolotriazole series couplers. A 5-pyrazolone series coupler substituted by an arylamino group or an acylamino group at the 3-position is preferred from the viewpoint of the hue and coloring speed of the colored dye. Typical examples of these couplers are described in U.S. Pat. Nos. 2,311,082, 2,343,703, 2,600,788, 2,908,573, 3,062,653, 3,152,896, 3,936,015, etc. Two-equivalent 5-pyrazolone series couplers are preferred in this invention and as the releasable group for the couplers, the nitrogen atom-releasing group described in U.S. Pat. No. 4,310,619 and the arylthio group described in U.S. Pat. No. 4,351,897 are preferred. Also, the 5-pyrazolone series couplers having the ballast groups described in European Pat. No. 73,636 show high coloring reactivity.

Examples of pyrazoazole series couplers that can be used in addition to the compounds for use in this invention represented by formula (I) include the pyrazolobenzimidazoles described in U.S. Pat. No. 3,369,897, preferably the pyrazolotetrazoles described in *Research Disclosure,* RD No. 24220 (June, 1984), and the pyrazolpyrazoles described in *Research Disclosure,* RD No. 24,230 (June, 1984). Also, the imidazopyrazole series couplers described in Japanese Patent Application No. 23,434/'83 and the pyrazolo[1,5-b][1,2,4]triazole series couplers described in Japanese Patent Application No. 45,513/'83 give colored dyes having less yellow side-absorption and high light fastness, and hence are most preferably used together with the magenta coupler represented by formula (I).

Cyan couplers which can be used in this invention include oil protected type naphtholic couplers and phenolic couplers. Specific examples of the naphtholic couplers are the naphtholic couplers described in U.S. Pat. No. 2,474,293 and the oxygen atom-releasing type high-active two-equivalent naphthol couplers described in U.S. Pat. Nos. 4,052,212, 4,146,396, 4,228,233, and 4,296,200. Specific examples of the phenolic couplers are described in U.S. Pat. Nos. 2,369,929, 2,423,730, 2,772,162, and 2,895,826.

Cyan couplers having fastness to heat, humidity, and light are preferably used in this invention, and typical examples of such cyan couplers are the phenolic cyan couplers described in U.S. Pat. No. 3,772,002, the 2,5-diacylamino-substituted phenolic cyan couplers described in U.S. Pat. Nos. 2,772,162, 3,758,308, 4,126,396, 4,334,011, and 4,327,173; West German Patent Application (OLS) No. 3,229,729; and Japanese Patent Application No. 42,761/'83; and the phenolic couplers having a phenylureido group at the 2-position and an acylamino group at the 5-position described in U.S. Pat. Nos. 3,446,622, 4,333,999, 4,451,559, 4,427,767, etc.

The couplers for use in this invention represented by formula (I) and the above-described couplers can be used in the same emulsion layer, as a combination of two or more kinds of the couplers, in order to satisfy the characteristics required for the photographic materials of this invention, or the same layers of the photographic material.

Moreover, in this invention, for correcting the undesired absorption of the colored dyes of the magenta coupler and the cyan coupler at a short wavelength region, it is preferred for color photographic materials to use colored couplers together with the above-described couplers. Typical examples of these colored couplers are the yellow-colored magenta couplers (i.e., yellow colored magenta-dye-forming couplers) described in U.S. Pat. No. 4,163,670 and Japanese Patent Publication No. 39,413/'82, and the magenta-colored cyan couplers described in U.S. Pat. Nos. 4,004,929, 4,138,258, and U.K. Pat. No. 1,146,368.

Black-coloring couplers which are used in X-ray photographic materials to conserve silver can be also used in this invention. Specific examples of such couplers are described in U.S. Pat. No. 4,126,461 and U.K. Pat. No. 2,102,136.

These color couplers may form dimers, oligomers or polymers. Typical examples of polymerized couplers are described in U.S. Pat. Nos. 3,451,820, 4,080,211, etc. Also, specific examples of polymerized magenta couplers are described in U.K. Pat. No. 2,102,173 and U.S. Pat. No. 4,367,282.

Also, couplers providing diffusible colored dyes can be used together with the foregoing couplers for improving graininess properties in this invention and specific examples of these couplers are magenta couplers described in U.S. Pat. No. 4,366,237 and U.K. Pat. No. 2,125,570 and yellow, magenta, and cyan couplers described in European Pat. No. 96,873 and West German Patent Application (OLS) No. 3,324,533.

As the binder or protective colloid for the silver halide emulsion layers, interlayers, etc. of the photographic materials of this invention, gelatin is advantageously used, but other hydrophilic colloids can be used individually or together with gelatin.

For the photographic emulsion layers of the photographic materials of this invention, silver bromide, silver iodobromide, silver iodochlorobromide, silver chlorobromide, or silver chloride may be used as the silver halide. A preferred silver halide is silver iodobromide containing less than 15 mole% silver iodide. A particularly preferred silver halide is silver iodobromide containing from 2 mole% to 12 mole% silver iodide.

There is no particular restriction on the mean grain size of the silver halide grains in the photographic emulsions (the mean grain size is the mean diameter of the grains when the silver halide grain is a spherical grain or a grain similar to spherical or is indicated as a mean value based on the projected areas by using an edge length as the grain size when the silver halide grain is a cubic grain).

The grain size distribution may be broad or narrow.

The silver halide grains in the photographic emulsions may have a regular form such as a cubic form or an octahedral form or may have an irregular crystal form such as a spherical form and a tabular form. Also, the silver halide grains may be a composite form of these crystal forms or may be composed of a mixture of the silver halide grains having various crystal forms.

Also, a silver halide emulsion containing tabular silver halide grains having a diameter more than 5 times the thickness thereof which account for about 50% or more of the whole projection areas of silver halide grains in the emulsion may be used in this invention.

The silver halide grains for use in this invention may have different phases between the inside thereof and the surface layer. Also, the silver halide grains may be ones forming latent images mainly on the surfaces thereof or ones forming latent images mainly in the insides thereof.

The silver halide emulsions for use in this invention can be prepared by the methods described in, for example, P. Glafkides, *Chimie et Physique Photographique* (published by Paul Montel Co., 1967), G. F. Duffin, *Photographic Emulsion Chemistry* (published by The Focal Press, 1966), V. L. Zelikman et al, *Making and Coating Photographic Emulsion* (published by The Focal Press, 1964), etc. That is, the photographic emulsions may be prepared by an acid process, a neutralization process, an ammonia process, etc. Also, as the mode of reacting a soluble silver salt and a soluble halogen salt, a single jet method, a double jet method, or a combination thereof may be used.

A so-called back mixing method for forming silver halide grains in the presence of an excessive amount of silver ions can be used. As one mode of the double jet method, a so-called controlled double jet method of preparing a silver halide emulsion while maintaining the pAg in the liquid phase wherein the silver halide is formed at a constant value can be also used. According to this method, a silver halide emulsion containing silver halide grains having a regular crystal size and substantially uniform grain sizes can be obtained.

Two or more silver halide emulsions separately prepared can be used as a mixture thereof.

The silver halide grains may be formed or physically ripened in the presence of a cadmium salt, a zinc salt, a lead salt, a thallium salt, an iridium salt or a complex salt thereof, a rhodium salt or a complex salt thereof, an iron salt or a complex salt thereof, etc.

The silver halide emulsions for use in this invention are usually chemically sensitized. The chemical sensitization can be performed using the methods described, for example, in H. Frieser edited, *Die Grundlagender Photographischen Prozesse mit Silberhalogeniden,* (Akademische Verlagsgesselschaft, 1968), pages 675–734.

For instance, there are a sulfur sensitization method using active gelatin or a sulfur-containing compound capable of reacting with silver (e.g., thiosulfates, thioureas, mercapto compounds, rhodanines, etc.); a reduction sensitization method using a reducing material (e.g., stannous salts, amines, hydrazine derivatives, formamidines, silane compounds, etc.); and a noble metal sensitization method using a noble metal compound (e.g., gold complex salts and complex salts of metals belonging to group VIII of the periodic table, such as Pt, Ir, Pd, etc.). They can be used individually or as a combination thereof.

The silver halide photographic emulsions for use in this invention may further contain various compounds for preventing the occurrence of fog during the production, storage, or photographic processing of the photographic materials of this invention or for stabilizing the photographic properties. Examples of these compounds include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyrimidines, mercaptotriazines; thioketo compounds such as oxazolinethione; azaindenes such as triazaidenes, tetraazaindenes (in particular, 4-hydroxy-substituted (1,3,3a,7)tetraazaindenes), pentaazaindenes, etc.; benzenethiosulfonic acid; benzenesulfinic acid, benzenesulfonic acid amide, etc.

The silver halide photographic emulsion layers of the photographic materials of this invention may further contain polyalkylene oxide or derivatives thereof, such as the ethers, esters, amines, etc., thioether compounds, thiomorpholines, quaternary ammonium compounds, urethane derivatives, urea derivatives, imidazole derivatives, 3-pyrazolidones, etc., for the purpose of increasing sensitivity, increasing contrast, or accelerating development.

The photographic materials of this invention can contain dispersions of water-insoluble or water sparingly soluble synthetic polymers for improving the dimensional stability of the photographic emulsion layers and other synthetic colloid layers.

The silver halide emulsions for use in this invention may be spectrally sensitized by methine dyes, etc. The dyes which are used for this purpose include cyanine dyes, merocyanine dyes, complex cyanine dyes, complex merocyanine dyes, holopolar cyanine dyes, hemicyanine dyes, styryl dyes, and hemioxonole dyes. Particularly useful dyes are cyanine dyes, merocyanine dyes, and complex merocyanine dyes there. For these dyes can be applied nuclei which are usually utilized for cyanine dyes as basic heterocyclic nuclei.

These sensitizing dyes may be used individually or as a combination thereof. A combination of sensitizing dyes is usually used for the purpose of super-sensitization.

The silver halide emulsions may further contain a dye which does not have a spectral sensitizing action by itself or a compound which does not substantially absorb visible light and shows super-sensitization together with the above-described sensitizing dye. Examples of such materials are aminostyryl compounds substituted by a nitrogen-containing heterocyclic group (described in, for example, U.S. Pat. Nos. 2,933,390 and 3,635,721), aromatic organic acid-formaldehyde condensation products (described in, for example, U.S. Pat. No. 3,743,510), cadmium salts, azaindene compounds, etc.

This invention can be applied to multilayer multicolor photographic material having on a support at least two silver halide emulsion layers each having different spectral sensitivity. A multilayer natural color photographic material usually has on a support at least one red-sensitive emulsion layer, at least one green-sensitive emulsion layer, and at least one blue-sensitive emulsion layer. The disposition order of these emulsion layers may be optionally selected according to the desired purpose. The red-sensitive emulsion layer usually contains a cyan-forming coupler, the green-sensitive emulsion layer a magenta-forming coupler, and the blue-sensitive emulsion layer a yellow-forming coupler but other combinations may be employed if desired.

The photographic materials of this invention may further contain inorganic or organic hardening agents in the silver halide emulsion layers and other synthetic colloid layers. Examples of such hardening agent are active vinyl compounds (e.g., 1,3-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. They can be used individually or as a combination thereof.

The photographic materials of this invention may further contain color fogging prevention agents such as hydroquinone derivatives, aminophenol derivatives, etc.

The photographic materials of this invention may contain ultraviolet absorbents in the hydrophilic colloid layers. Examples of such ultraviolet absorbents are the aryl group-substituted benzotriazoles described in, for example, U.S. Pat. Nos. 3,533,794, 4,236,013; Japanese Patent Publication No. 6540/'76; and European Pat. No. 57,160, the butadienes described in U.S. Pat. Nos. 4,0450,229 and 4,195,999, the cinnamic acid esters described in U.S. Pat. Nos. 3,705,805 and 3,707,375, the benzophenones described in U.S. Pat. No. 3,215,530 and U.K. Pat. No. 1,321,355, and the macromolecular compounds having a ultraviolet absorptive residue as described in U.S. Pat. Nos. 3,761,272 and 4,431,726. Ultraviolet absorptive optical whitening agents as described in U.S. Pat. Nos. 3,499,762, 3,700,455, etc. may be used. Typical examples of ultraviolet absorbents are described, for example, in *Research Disclosure* No. 24239 (1984, June), etc.

The photographic materials of this invention may further contain water-soluble dyes as filter dyes or for irradiation prevention and various other purposes in the hydrophilic colloid layers. Examples of such dyes are oxonol dyes, hemioxonol dyes, styryl dyes, merocyanine dyes, cyanine dyes, and azo dyes. In these dyes, oxonol dyes, hemioxonol dyes, and merocyanine dyes are useful.

In the practice of this invention, fading preventing agents or dye image stabilizers may also be used together with the above-described couplers. The dye image stabilizers may be used singly or as a mixture thereof. Examples of the fading preventing agents are hydroquinone derivatives, gallic acid derivatives, p-alkoxyphenols, p-oxyphenol derivatives, bisphenols, etc.

The photographic material of this invention is prepared by coating silver halide emulsions for forming dye image-forming layers on a flexible support usually used for photographic materials, such as a plastic film, a paper, a cloth, etc.

Examples of the useful flexible support are films composed of a semisynthetic or synthetic polymer such as cellulose acetate, cellulose acetate butyrate, polystyrene, polyethylene terephthalate, polycarbonate, etc.; and papers coated or laminated with a baryta layer or $\alpha$-olefin polymer (e.g., polyethylene, polypropylene, etc.). The support may be colored by using a dye or pigment or may be colored in black for the purpose of light shielding.

When the support is used for reflection type photographic materials, it is preferred to add a white pigment. Examples of the white pigment are titanium dioxide, barium sulfate, zinc oxide, zinc sulfide, calcium carbonate, antimony trioxide, silica white, alumina white, titanium phosphate, etc. Of these pigments, titanium dioxide, barium sulfate, zinc oxide, etc., are particularly advantageous.

A subbing treatment is generally applied to the surface of the support for improving the adhesion for photographic emulsion layers, etc. Furthermore, the surface of the support may be subjected to corona discharging, ultraviolet irradiation, flame treatment, etc., before and/or after the subbing treatment.

Also, in the case of reflective type photographic materials, a hydrophilic colloid layer containing a white pigment at a high concentration can be formed between the support and the silver halide emulsion layer for improving the whiteness and the sharpness of the photographic images.

In reflective type photographic materials containing the magenta couplers of this invention, polymer-laminated paper supports are frequently used as the support, but a synthetic resin film kneaded with a white pigment can also be used as the support. In the latter case, the photographic material is excellent in flatness, luster, and sharpness, and photographic images particularly excellent in saturation and regeneration of dark area are obtained. In this case, as the synthetic resin film, polyethylene terephthalate, cellulose acetate, etc., are preferably used and as the white pigment, barium sulfate, titanium oxide, etc., are particularly preferred.

The color photographic materials of this invention may further contain various other additives known in the art, such as stabilizers, antifoggants, surface active agents, antistatic agents, developing agents, etc., and specific examples of these additives are described in *Research Disclosure,* No. 17643 (December, 1978).

Furthermore, as the case may be, the photographic materials of this invention may contain, in the silver halide emulsion layers or synthetic colloid layers, a fine grain silver halide emulsion having substantially no light sensitivity (e.g., a silver chloride, silver bromide, or silver chlorobromide emulsion having a mean grain size of less than 0.20 $\mu$m).

A color developer for processing the color photographic materials of this invention is an alkaline aqueous solution containing, preferably, an aromatic primary amine color developing agent as the main component. Examples of the color developing agent are 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, 4-amino-3-methyl-N-ethyl-N-$\beta$-methoxyethylaniline, etc.

The color developer may contain a development inhibitor or antifoggant such as a bromide, an iodide, and an organic antifoggant, or a pH buffer such as the sulfites, carbonates, borates, and phosphates of alkali metals. Also, the color developers may contain, if necessary, water softeners; preservatives such as hydroxylamine, etc.; organic solvents such as benzyl alcohol, diethylene glycol, etc.; development accelerators such as polyethylene glycol, quaternary ammonium salts, amines, etc.; dye-forming couplers; competing couplers; fogging agents such as sodium borohydride, etc.; auxiliary developing agents such as 1-phynyl-3-pyrazolidone, etc.; tackifiers; the polycarboxylic acid chelating agents described, for example, in U.S. Pat. No. 4,083,723; the antioxidants described in West German Patent Application (OLS) No. 2,622,950, etc.

The color photographic materials of this invention are usually bleached after color development. The bleach process may be performed simultaneously with or separately from a fix process. Examples of the bleaching agent are compounds of multivalent metals such as iron(III), cobalt(III) chromium(VI), copper(II), etc., peracids, quinones, nitroso compounds, etc. Specific examples of the bleaching agent are ferricyanides, dichromates, organic complex salts of iron(III) or cobalt(III); aminopolycarboxylic acids such as ethylenediaminetetraacetic acid, nitrilotriacetic acid, 1,3-diamino-2-propanoltetraacetic acid, etc.; complex salts of organic acids such as citric acid, tartaric acid, malic acid, etc.; persulfates; manganates; nitrosophenol, etc.

In these materials, potassium ferricyanide, ethylenediaminetetraacetic acid iron(III) sodium and ethylenediaminetetraacetic acid iron(III) ammonium are particularly useful. The ethylenediaminetetraacetic acid iron(III) complex salts are useful in both the bleach solution and the mono-bath bleach solution (blix solution).

The photographic materials may be washed with water after a color development and/or bleach and fix processes or a blix process.

The color development can be performed at temperatures between 18° C. and 55° C. The color development is preferably performed at temperatures above 30° C., in particular above 35° C. The developing time can be in a range of about 1 min. to about 3.5 min., but is generally made as short as practically possible.

For continuous processing of color photographic materials, a supplement of the development liquid is preferred, and a fresh developer is usually supplemented in an amount of from 160 ml to 330 ml, preferably less than 100 ml per square meter of the processing area. When benzyl alcohol is used for a color developer, the content thereof is preferably less than 5 ml/liter.

The blix process can be practiced at 18° C. to 50° C., preferably above 35° C. When the blix is performed above 35° C., the processing time can be reduced less than 1 min. as well as the supplemental amount of the processing liquid can be reduced.

The time required for washing applied after color development or bleach and fix or blix is usually within 3 minutes and can be reduced within one minute by using a stabilization bath.

Colored dyes are generally deteriorated by the action of light, heat, and humidity, as well as being faded by fungi. The deterioration of cyan dye images by fungi is particularly a problem, and it is preferred to use an antifungal agent. Examples of antifungal agents are the 2-thiazolylbenzimidazoles described in Japanese Patent Application (OPI) No. 157,244/'82. The antifungal agent may be incorporated in the photographic materials or may be added from outside in the development process. The addition of the antifungal agent may be performed in any step provided that the agent in the photographic materials after processing.

Then, the invention will be explained by referring to the following examples, but the invention is not limited thereto.

REFERENCE EXAMPLE 1

The magenta dye having formula shown below, synthesized by reacting magenta coupler (M-2) illustrated above and the developing agent shown below in the presence of ammonium persulfate and potassium carbonate, was dissolved in an equi-amount of organic solvent (S-7) illustrated above, using ethyl acetate as an auxiliary solvent and after evaporating the ethyl acetate, then the visible absorption spectrum of the solution of the dye was measured.

Developing Agent:

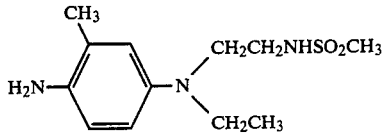

Magenta Dye:

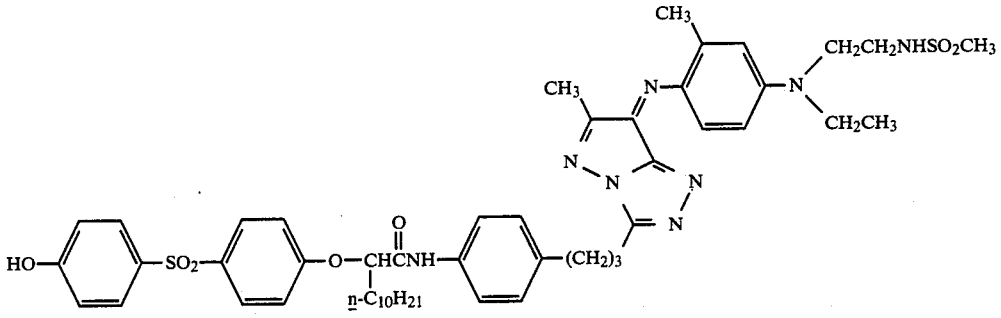

For a comparison example, the above-described magenta dye was dissolved in an equi-amount of dibutyl phthalate and the visible absorption spectrum of the solution of the dye was measured. (Comparison Example 1).

Furthermore, a comparison magenta dye shown below was dissolved in an equi-amount of organic solvent (S-7) illustrated above to the dye having the same structure as above and was dissolved in dibutyl phthalate to form a solution (Comparison Example 3). The visible absorption spectrum of each solution was measured.

The above-described absorption spectra are shown in FIG. 1 of the accompanying drawings (the spectra are shown by standardizing the absorption maximum as 1.0).

Comparison Magenta Dye:

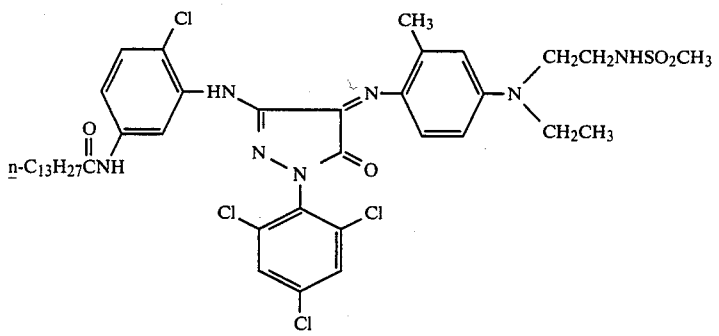

From the results shown in FIG. 1, it can be seen that there is no large difference in the absorption spectrum between the case of dissolving the magenta dye of a comparison 5-pyrazolone series coupler in the phosphoric acid ester series solvent of this invention and the case of dissolving the dye in dibutyl phthalate, but when the magenta dye of the 1H-pyrazolo-[5,1-c][1,2,4]triazole type in this invention is in the phosphoric acid ester series solvent in this invention, the shape of the skirt portion of the absorption spectrum at the long wavelength side is greatly improved as compared with the case of dissolving the magenta dye in dibutyl phthalate. Furthermore, it can be seen that since the magenta dye of the 1H-pyrazolo[5,1-c][1,2,4]triazole type in this invention has no side-absorption at a short wavelength side, the absorption spectrum in the case of dissolving the magenta dye in the phosphoric ester series solvent in this invention is suitable for the improvement of the color reproducibility of color photographic materials.

The foregoing visible absorption spectra were measured using Automatic Recording Spectrophotometer Type 340, made by Hitachi, Ltd.

EXAMPLE 1

Magenta coupler (M-7) (10 g) as in Reference Example 1 was dissolved in 20 g of organic solvent (S-7) with the addition of 25 ml of ethyl acetate while heating. The solution thus obtained was added to 100 ml of an aqueous solution containing 10 g of gelatin and 1.0 g of sodium dodecylbenzenesulfonate followed by stirring at high speed to provide a fine emulsified dispersion. The whole amount of the emulsified dispersion thus obtained was added to 100 g of a silver chlorobromide emulsion (containing 50 mole% Br and 6.55 g of Ag). after adding thereto 10 ml of a solution of 2% 2,4-dihydroxy-6-chloro-s-triazine sodium salt as a hardening agent, the dispersion was coated on a paper support both surfaces of which were laminated by polyethylene at a silver coverage of 200 mg/m$^2$ and, then a gelatin layer was formed on the layer to provide Sample A.

Then, by following the same procedure as above except using tricresyl phosphate or di-2-ethylhexyl phthalate in place of above-described solvent (S-7), Samples B and C were prepared.

Furthermore, by also following the above procedure using a coupler having the structure shown below in place of the magenta coupler described above, and using solvent (S-7) as the high-boiling organic solvent, Sample D was prepared.

Comparison Magenta Dye:

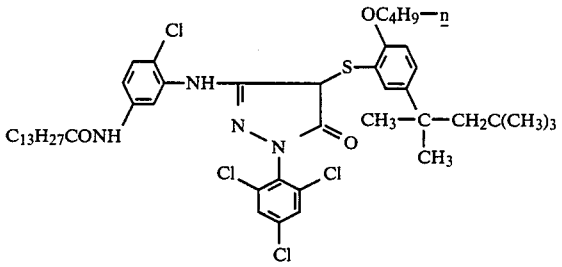

Each of Samples A–D thus obtained was subjected to wedge exposure of 1000 CMS and processed by the following processing steps.

| Processing step | Temperature | Time |
|---|---|---|
| Development | 33° C. | 3 min. 30 sec. |
| Blix | 33° C. | 1 min. 30 sec. |
| Wash | 28–35° C. | 3 min. |

The compositions of the processing liquids used in the above processing steps were as follows.

| | |
|---|---|
| Developer: | |
| Benzyl alcohol | 15 ml |
| Diethylenetriamine Penta-acetate | 5 g |
| KBr | 0.4 g |
| $Na_2SO_3$ | 5 g |
| $Na_2CO_3$ | 30 g |
| 4-Amino-3-methyl-N—β-(methanesulfonamido)ethylaniline.3/2$H_2SO_4$.$H_2O$ | 4.5 g |
| Water to make | 1000 ml |
| | pH 10.1 |
| Blix Solution: | |
| Ammonium thiosulfate (70 wt. %) | 150 ml |
| $Na_2SO_3$ | 5 g |
| Na[Fe(EDTA)] | 40 g |
| EDTA | 4 g |
| Water to make | 1000 ml |
| | pH 6.8 |

Figure 2:
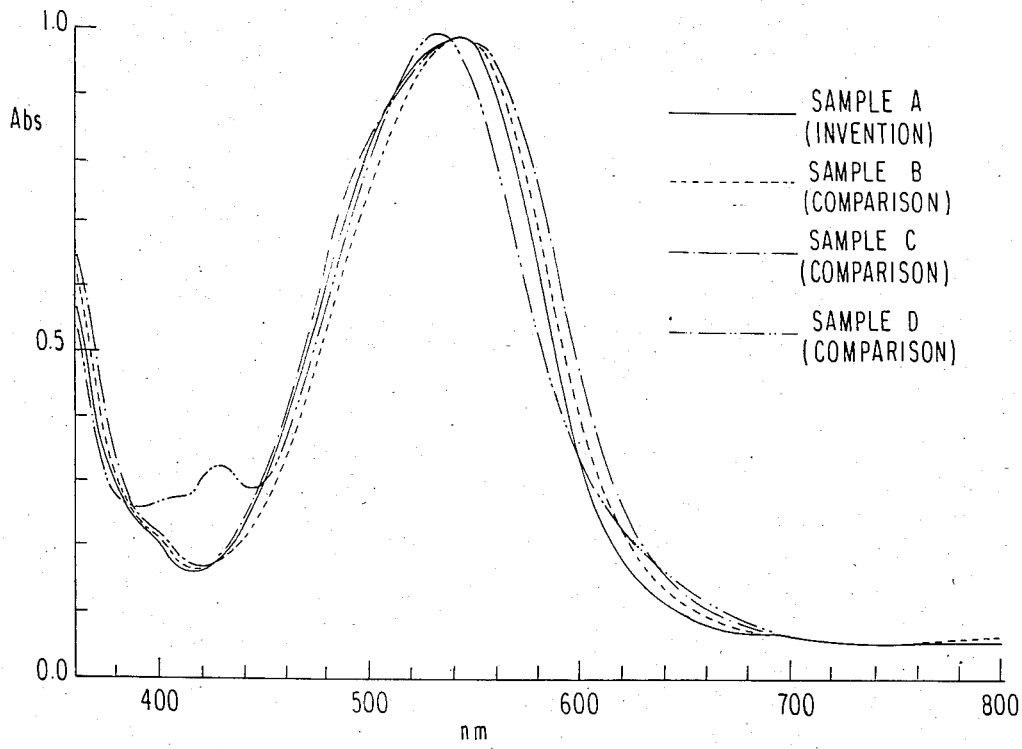
FIG. 2 shows the reflection spectra of magenta colored dyes.

Then the reflection spectrum of the dye image of each sample thus obtained was measured by means of Automatic Recording Spectrophotometer Type 340, made by Hitachi, Ltd., equipped with an integrating sphere for enabling the measurement of reflection spectra at a Dmax of 1.0, and the results thus obtained are shown in FIG. 2.

From the results, it can be seen that the high-boiling alkyl phosphate series solvent in this invention provides for the 1H-pyrazolo[5,1-c][1,2,4]triazole magenta coupler in this invention desired spectral absorption characteristics for magenta couplers in subtractive color photography. That is, the absorption characteristics show less absorption on a long wavelength side (longer than 600 nm), show no unnecessary absorption on the short wavelength side, in contrast to a pyrazolone coupler, and are thus very useful for color reproduction.

EXAMPLE 2

Each of Samples, E, F, G, and H of color photographic materials was prepared by forming on a paper support, both surfaces of which were laminated with polyethylene, following Layer 1 to Layer 7. The coating liquid for each silver halide emulsion layer was prepared by following the procedure as in Example 1 and each magenta coupler and high-boiling solvent (oil) for each Layer 3 are shown in Table I.

Layer 1: A layer containing a blue-sensitive silver chlorobromide emulsion (80 mole% Br, silver coverage of 350 mg/m$^2$), 1500 mg/m$^2$ of gelatin, 500 mg/m$^2$ of yellow coupler (*7), and 400 mg/m$^2$ of solvent (*8).

Layer 2: A layer containing 1100 mg/m$^2$ of gelatin, 200 mg/m$^2$ of color mixing preventing agent (*4), and 100 mg/m$^2$ of solvent (*2).

Layer 3: A layer containing a green-sensitive silver chlorobromide emulsion (50 mole% Br, silver coverage of 180 mg/m$^2$), 275 mg/m$^2$ of magenta coupler (*5), and 550 mg/m$^2$ of solvent (*6).

Layer 4: A layer containing 1600 mg/m$^2$ of gelatin, 700 mg/m$^2$ of ultraviolet absorbent (*1), 200 mg/m$^2$ of color mixing preventing agent (*4), and 300 mg/m$^2$ of solvent (*2).

Layer 5: A layer containing a red-sensitive silver chlorobromide emulsion (50 mole% Br, silver coverage of 300 mg/m$^2$), 1200 mg/m$^2$ of solvent.

Layer 6: A Layer containing 1000 mg/m$^2$ of gelatin, 360 mg/m$^2$ of ultraviolet absorbent (*1), and 120 mg/m$^2$ of solvent (*2).

Layer 7: A layer containing 1600 mg/m$^2$ of gelatin.

(*1) Ultraviolet Absorbent: 2-(2-hydroxy-3-sec-butyl-5-tert-butylphenyl)benzotriazole.

(*2) Solvent: Dibutyl phtahlate.

(*3) Cyan Coupler: 2-[α-(2,4-di-tert-pentylphenoxy)-butanamido]-4,6-dichloro-5-methylphenol.

(*4) Color Mixing Preventing Agent: 2,5-Dioctylhydroquinone.

(*5) Magenta Coupler: Shown in Table I (*6) Solvent: Shown in Table I (*7) Yellow Coupler: α-Pivaloyl-α-(2,4-dioxo-5,5'-dimethyloxazolidine-3-yl)-2-chloro-5-[α-(2,4-di-tert-pentylphenoxy)butanamido]acetanilide.

(*8) Solvent: Dioctylbutyl phosphate.

TABLE I

| Sample | Coupler for Layer 3 | Solvent for Layer 3 | Color Reproducibility | Color Image Preservability |
|---|---|---|---|---|
| E | M-2 | S-7 | good | 0.74 |
| F | " | TCP | poor | 0.71 |
| G | " | DEHP | poor | 0.56 |
| H | Comparison coupler A | S-7 | poor | |

TCP: Tricresyl phosphate
DEHP: Di-2-ethylhexyl phthalate
Comparison Coupler A: Same as in Example 1
Sample E: Sample of this invention
Sample F to H: Comparison samples Each of four samples E to H thus prepared was exposed using a negative having a color patch image and using three separated filters, viz., blue, green, and red, and developed.

In these cases, the reproduction of the color patch was most clear in Sample E and in particular, the saturation of red was high in Sample E. In other samples, the saturation of the color patch reproduced was low, in particular, the reproduction of red became bluish purple, which showed undesirable color reproduction.

Then, color images obtained by color developing Samples E, F, and G were subjected to fading test using a fluorescent fade-o-meter (15000 lux) for 3 weeks and the results obtained are shown in Table I above.

In addition, the color image preservability in Table II is the density after light exposure of a portion of the color image having an initial density of 1.0.

From the results shown in Table I, it can be seen that the use of the alkyl phosphate series high-boiling solvent in this invention for a 1H-pyrazolo[5,1-c][1,2,4]triazole in this invention is also effective for the light fastness of color images produced.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having formed thereon at least one silver halide emulsion layer having dispersed therein, in a coexisting state, at least one magenta coupler represented by formula (I) and at least one high-boiling point organic solvent represented by formula (II)

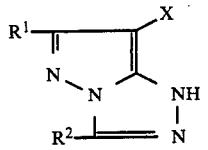

(I)

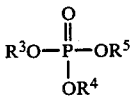

(II)

wherein $R^1$ and $R^2$ each represents a hydrogen atom or a substituent and X represents a hydrogen atom or a group capable of being released by a coupling reaction with the oxidation product of an aromatic primary amine developing agent; and wherein, $R^3$, $R^4$, and $R^5$ each represents an alkyl group, a cycloalkyl group, or an alkenyl group, and the total number of carbon atoms of the groups $R^3$, $R^4$, and $R^5$ is from 12 to 60, wherein the weight ratio of the high-boiling point organic solvent represented by formula (II) to the magenta coupler represented by formula (I) is from 0.05/1 to 20/1.

2. A silver halide color photographic material as in claim 1, wherein $R^1$ and $R^2$ each represents a hydrogen atom, a halogen atom, an alkyl group, an aryl group, a heterocyclic ring group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group.

3. A silver halide color photographic material as in claim 1, wherein $R^1$ and $R^2$ each represents an alkyl group.

4. A silver halide color photographic material as in claim 1, wherein $R^1$ represents a methyl group and $R^2$ represents a substituted alkyl group.

5. A silver halide color photographic material as in claim 1, wherein X represents a halogen atom.

6. A silver halide color photographic material as in claim 1, wherein X represents a group linking by an oxygen atom.

7. A silver halide color photographic material as in claim 1, wherein $R^3$, $R^4$ and $R^5$ each represents a 2-ethylhexyl group, a 7-methyloctyl group or a cyclohexyl group.

8. A silver halide color photographic material as in claim 1, wherein $R^3$, $R^4$ and $R^5$ each represents a straight-chain alkyl group having from 8 to 18 carbon atoms.

* * * * *